US006943698B2

(12) United States Patent
Jones et al.

(10) Patent No.: US 6,943,698 B2
(45) **Date of Patent: *Sep. 13, 2005**

(54) ENHANCED VISIBILITY TRAFFIC SIGNAL

(75) Inventors: Dale G. Jones, 1984 San Luis Dr., San Luis Obispo, CA (US) 93401; Barbara L. Marcum, 1984 San Luis Dr., San Luis Obispo, CA (US) 93401; Jerry A. Williams, 2331 S. Hall St., Visalia, CA (US) 93277; Priscilla Williams, 2331 S. Hall St., Visalia, CA (US) 93277

(73) Assignees: Dale G. Jones, San Luis Obispo, CA (US); Barbara L. Marcum, San Luis Obispo, CA (US); Jerry A. Williams, Nipomo, CA (US); Priscilla Williams, Nipomo, CA (US)

( * ) Notice: Subject to any disclaimer, the term of this patent is extended or adjusted under 35 U.S.C. 154(b) by 133 days.

This patent is subject to a terminal disclaimer.

(21) Appl. No.: 10/648,943

(22) Filed: Aug. 26, 2003

(65) Prior Publication Data

US 2004/0036629 A1 Feb. 26, 2004

Related U.S. Application Data

(63) Continuation of application No. 09/353,001, filed on Jul. 13, 1999, now Pat. No. 6,693,556.

(60) Provisional application No. 60/092,618, filed on Jul. 13, 1998.

(51) Int. Cl.[7] ..... G08G 1/095

(52) U.S. Cl. ..... 340/907; 340/908; 340/309.16; 340/515.4; 340/815.45; 362/800; 362/812

(58) Field of Search ..... 340/907, 908, 340/309.16, 815.4, 815.45; 362/800, 812

(56) References Cited

U.S. PATENT DOCUMENTS

| | | | |
|---|---|---|---|
| 4,104,562 | A | 8/1978 | DiCola |
| 4,250,483 | A | 2/1981 | Ruber |
| 4,298,869 | A | 11/1981 | Okuno |
| 4,710,053 | A | 12/1987 | Kulp et al. |
| 4,841,278 | A | 6/1989 | Tezuka et al. |
| 5,136,287 | A | 8/1992 | Borenstein |
| 5,313,187 | A | 5/1994 | Choi et al. |
| 5,339,081 | A | 8/1994 | Jefferis et al. |
| 5,457,450 | A | 10/1995 | Deese et al. |
| 5,577,824 | A | 11/1996 | Wright |
| 5,633,629 | A | 5/1997 | Hochstein |
| 5,796,376 | A | 8/1998 | Banks |
| 5,986,576 | A | 11/1999 | Armstrong |
| 6,054,932 | A | 4/2000 | Gartner et al. |
| 6,107,941 | A | 8/2000 | Jones |
| 6,150,771 | A | 11/2000 | Perry |
| 6,243,644 | B1 | 6/2001 | Dengler |

*Primary Examiner*—Julie Bichngoc Lieu
(74) *Attorney, Agent, or Firm*—Christie, Parker & Hale, LLP

(57) ABSTRACT

A traffic control signal has a structure upon which traffic control indicia are formed. At least one LED is formed upon the structure so as to attract attention to the indicia. The LED(s) have a brightness of at least 6,000 millicandella and preferably have a brightness of between approximately 6,000 millicandella and approximately 60,000 millicandella.

32 Claims, 10 Drawing Sheets

SOLAR PANEL
SIEMENS SM-6
6W RATING
20
INTEGRATED
TIMER CIRCUIT
TLC 555
43
41
386K
(10K
MIN.)
1/2W
118K
1/2W
40
37
2.2μf
35V
38
0.1μf
50V
34
35
2N2222
(4 PLACES)
36
0.1μf
50V
10K
1/4W
33
32
10.2V
ZENER
IN758A
31
10K
1/4W
OPEN SW
30
29
IN4007
27
IN4007
HgSW
56
FUSE
57
25
10Ω
1/4W
26
1200
12mAh
24
BATTERY
12V
21
6.8K
1/4W
22
THERMISTOR
10K@77F
23
10K
1/4W
46
49
45a
45b
45c
45d
45e
45f
45g
45h
LED'S ON
"STOP"SIGN
48
120Ω
1/2W
47
120Ω
1/2W

ENHANCED VISIBILITY TRAFFIC SIGNAL

RELATED APPLICATION

This is a continuation of application Ser. No. 09/353,001, filed on Jul. 13, 1999 now U.S. Pat. No. 6,693,556, entitled ENHANCED VISIBILITY TRAFFIC SIGNAL, which claims the benefit of the filing date of U.S. Provisional Patent Application Ser. No. 60/092,618, filed on Jul. 13, 1998 and entitled PROCESS AND APPARATUS FOR LED-ACTIVATED TRAFFIC SIGNAL, the contents of which are hereby expressly incorporated by reference.

FIELD OF THE INVENTION

The present invention relates generally to traffic signals and relates more particularly to an enhanced visibility traffic signal, such as a stop sign, which has a plurality of lights, such as light emitting diodes, or LEDs, disposed thereupon, so as to attract attention thereto in a manner which makes the traffic signal more likely to be seen and obeyed.

BACKGROUND OF THE INVENTION

Traffic signals for regulating the flow of traffic upon roadways are well known. Common examples of such traffic signals include stop signs, yield signs and speed limit signs, as well as a plurality of other signs and the like which are intended to control traffic and/or to provide helpful directions.

Of these various different traffic control signs, stop signs are particularly important because failure to obey a stop sign is especially likely to result in an automobile accident. Such automobile accidents frequently result in undesirable automobile damage, personal injury and/or death. Of course, the failure to obey various other traffic control signs and the like also frequently results in such automobile accidents.

Occasionally, the failure to obey such critical traffic control signs results from a difficulty or inability to see the traffic control sign. Sometimes not seeing such traffic control signs results from nearby distractions, which cause the driver to pay attention to something other than the traffic control sign. Other times, the traffic signs may be partially obstructed by foliage, or the driver may merely be inattentive. In any instance, drivers occasionally overlook critical traffic control signs and thereby risk automobile damage, personal injury and death.

Further, the ability of a driver to see traffic control signs and the like is generally dependent upon the ambient lighting conditions. For example, traffic control signs are substantially more difficult to see during periods of darkness or near darkness as well as during adverse weather conditions, e.g., overcast, fog, rain, sleet or snow.

Contemporary stop signs having LEDs formed thereon are known. For example, clusters of LEDs are being used to replace the red incandescent lights in the traffic signals, where 300 or more LEDs are clustered together to provide sufficient brightness. Such contemporary illuminated signs have been used by the prior art in an attempt to mitigate the above described problems associated with the difficulty or inability to see stop signs during darkness, near darkness and adverse weather conditions. However, such contemporary illuminated stop signs utilize LEDs which have a typical brightness of 1,500 millicandella or less and which thus do not contribute substantially to enhancing the visibility of the stop sign. Further, the total included radiation pattern angle of the LED clusters in such contemporary illuminated stop signs is generally greater than 20 degrees, thus undesirably reducing their effectiveness to be visible at a distance or in adverse conditions.

Those skilled in the art will appreciate that the ability of LEDs to contribute to enhancing the visibility of a stop sign or the like is dependent upon the brightness of the LEDs and also the radiation pattern angle thereof. Greater brightness provides more light, thus making the LEDs easier to see. A smaller radiation angle concentrates the available light, again making the LEDs easier to see.

In view of the foregoing, it is desirable to provide traffic signals having enhanced visibility, so as to enhance the likelihood of the traffic signal being seen and obeyed and thereby mitigate the likelihood of accidents occurring as a result of failure to observe the traffic signal.

SUMMARY OF THE INVENTION

The present invention specifically addresses and alleviates the above-mentioned deficiencies associated with the prior art. More particularly, the present invention comprises a traffic control signal having a structure which has traffic control indicia formed thereon. At least one LED, preferably a plurality of LEDs, is formed upon the structure so as to attract attention to the indicia. The LEDs of the present invention have a brightness of at least 6,000 millicandella. The LEDs of the present invention preferably have a brightness of between approximately 6,000 millicandella and approximately 60,000 millicandella.

Further, the LEDs of the present invention preferably have a radiation pattern with a total included angle of less than approximately 20 degrees, preferably less than approximately 10 degrees.

Thus, as those skilled in the art will appreciate, the traffic control sign of the present invention has substantially enhanced visibility, particularly in darkness, near darkness and in adverse weather conditions. The substantially enhanced visibility of the present invention is provided by the greater brightness and reduced radiation pattern angle of the LEDs utilized.

These, as well as other advantages of the present invention, will be more apparent from the following description and drawings. It is understood that changes in the specific structure shown and described may be made within the scope of the claims without departing from the spirit of the invention.

DETAILED DESCRIPTION OF THE INVENTION

The detailed description set forth below in connection with the appended drawings is intended as a description of the presently preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
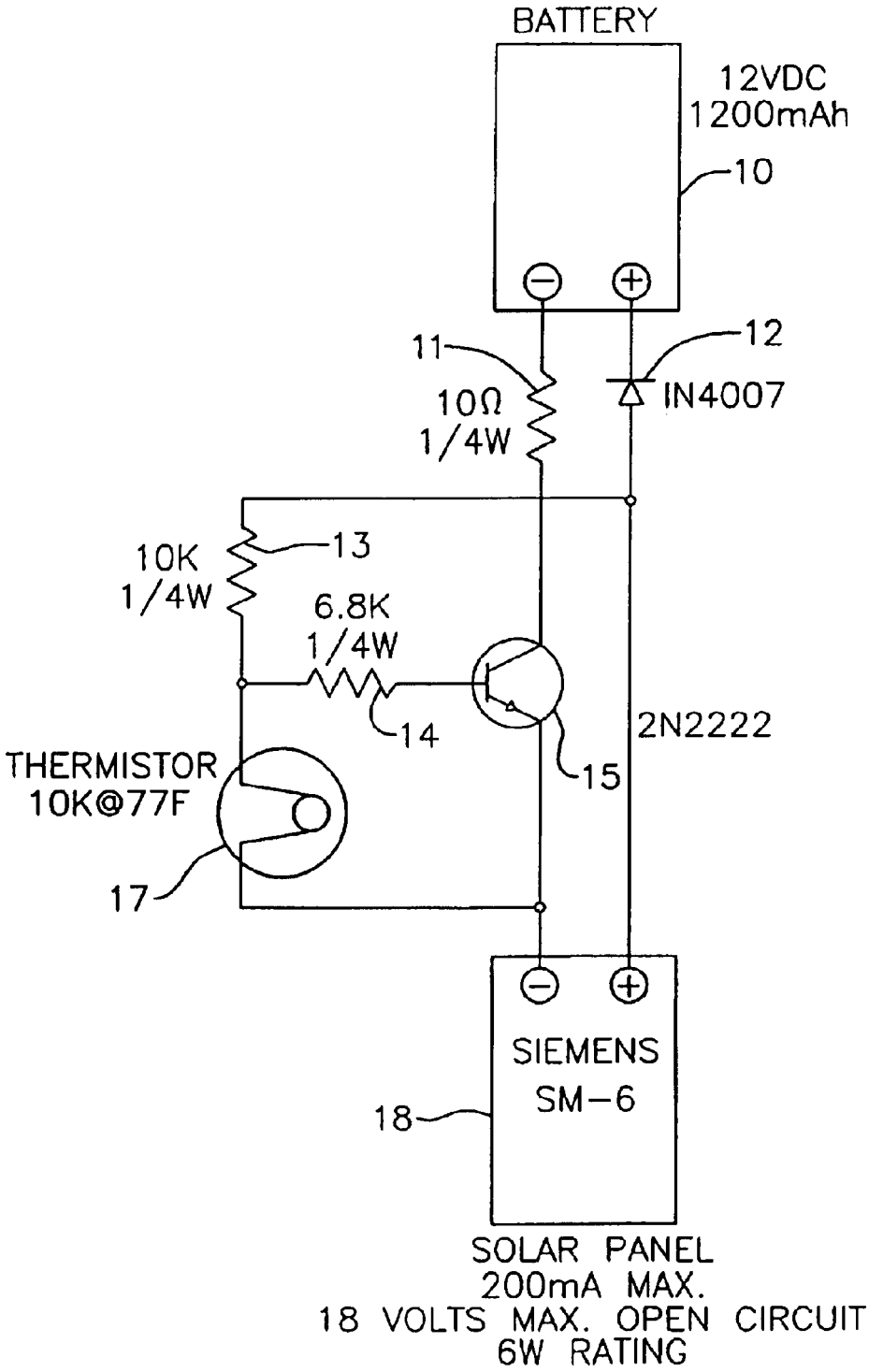
FIG. 1 is an electrical schematic showing a solar-powered battery charging circuit for the enhanced visibility traffic sign of the present invention.

Referring now to FIG. 1, the battery charging circuit of the present invention is configured so as to mitigate problems associated with over charging which may occur when the ambient temperature is excessively hot, e.g., on very sunny days. Those skilled in the art will appreciate that excessive charging of some rechargeable batteries, particularly when the temperature of the battery is high, is undesirable.

The battery charging circuit of the present invention is also configured so as to avoid excessive discharging of the battery through the solar panel during period of reduced illumination, e.g., at night or in adverse weather conditions.

Resistors 11, 13, and 14 provide desired biasing to transistor 15 which functions as a switch so as to significantly decrease the current path between the battery 10 and the solar panel 18 when the temperature of temperature-sensitive resistor, or thermistor 17 is raised above a predetermined threshold value. Thus, thermistor 17 functions as a temperature sensor, so as to provide a control input to transistor 15, which allows significant current flow from the solar panel 18 into the battery 10 only when the ambient temperature is below the predefined threshold value. Thus, the lifetime of the battery is extended by reducing the charging current as ambient temperature increases.

In operation, the thermistor 17 and the 6.8K resistor 14 form a voltage divider. As temperature increases, the thermistor resistance decreases, causing less current to flow through the 6.8K resistor 14 and thereby decreasing the battery charging current. Conversely, as temperature decreases, the reverse effect takes place. The thermistor 17 preferably has a resistance of 10K at 77 degrees F. and the resistance varies within a typical range of about 27K at 32 degrees F. to 4K at 120 degrees F.

Diode 12 inhibits undesirable discharging of the battery 10 through the solar panel 18 during conditions of reduced ambient lighting, such as at night when the voltage developed by solar panel 18 may be less than the voltage charge of the battery 10.

The present invention preferably comprises either one or two 12 vdc, 1600 milliamp-hour rechargeable nickel metal hydride (NiMH) batteries. The solar panel preferably comprises an 18-volt maximum open-circuit, 6 watt, Siemens SM-6 solar panel, rated 330 mA, but in normal sunny condition provides about 200 mA maximum, and in shady, dim, or bright foggy conditions, provides about 24 to 32 mA at 12.3 volts sufficient for battery recharging.

Figure 2:
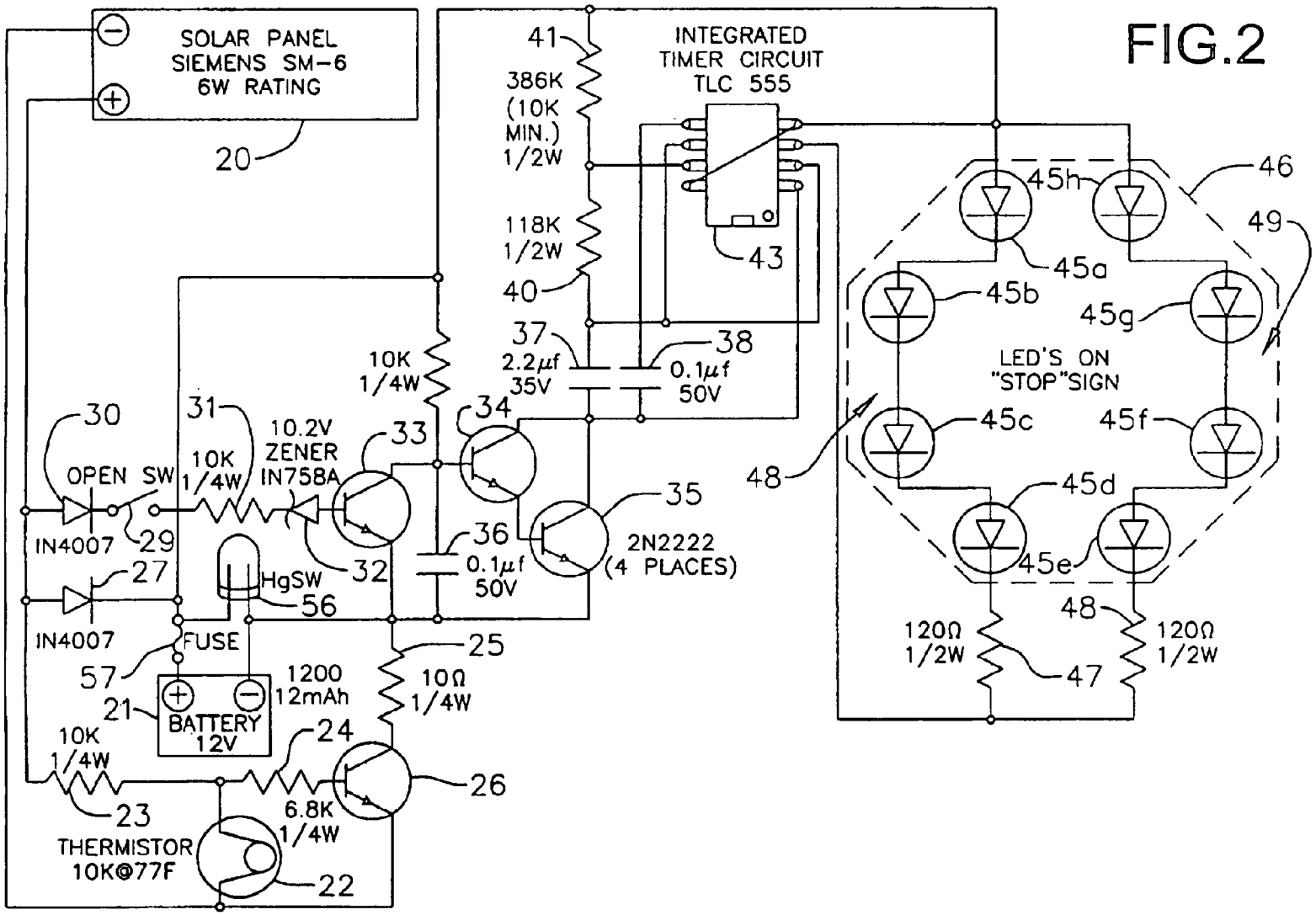
FIG. 2 is an electrical schematic showing the LED control circuity for the enhanced visibility traffic control sign of the present invention.

Referring now to FIG. 2, one preferred embodiment of the present invention comprises a solar panel 20 coupled so as to charge a battery 21, substantially as shown in FIG. 1.

Thermistor 22 is coupled so as to inhibit charging of the battery 21 by the solar panel 20 when ambient temperature exceeds a predetermined threshold value. Biasing resistors 23, 24 and 25 cooperate with thermistor 22 so as to cause transistor 26 to conduct substantially only when ambient temperature is below the predetermined threshold value. Transistor 26 is preferably mounted to a 3/16-inch diameter can, or the like, which will function as a heat sink therefor. In this manner, undesirable charging of the battery 21 by the solar panel 20 during periods of hot temperature is avoided, as discussed above. It is also common practice to locate thermistor 22 on the surface of battery 21 to thereby detect the increased temperature of the battery itself caused by recharging.

Diode 27 prevents the battery 21 from discharging through the solar panel 20 when ambient lighting is insufficient to effect charging of the battery 21 by the solar panel 20.

On/off switch 29 allows the LEDs 45*a*–45*h* to be turned on or off either manually or remotely, as discussed in detail below. Diode 30 prevents reverse current flow through the solar panel 20 during periods of low illumination. Resistor 31 cooperates with zener diode 32, capacitor 36, and transistors 33, 34 and 35 to effect switching on of the LEDs 45*a*–45*h* only when ambient illumination detected by solar panel 20 has dropped below a predetermined threshold value. The LEDs 45*a*–45*h* preferably comprise Toshiba TLRH190P LEDs, or similar high output InGaAlP LEDs with peak emission wavelength between 560 and 660 nanometers in the visible light spectrum.

Each LED 45*a*–45*h*, preferably comprises a jumbo 10 mm diameter LED which provides a much brighter output intensity than conventional LEDs having smaller diameters. For example, the output intensity, measured in millicandella, is typically from about 100 to 600 for conventional LEDs, while the output light for jumbo LEDs is typically greater than approximately 6,000 millicandella.

Commercially available jumbo LEDs, which require approximately 20 milliamps of current, may provide intensities up to 60,000 millicandella.

Such LEDs emit a very bright and comparatively narrow beam of light having a total included cone angle or radiation pattern angle of less than about 7 degrees. Indeed, many types of the jumbo LEDs have even a smaller total included cone angle or radiation pattern angle of less than about 4 degrees. Since traffic signs are typically pointed toward oncoming traffic, the emitted light from such LEDs is thereby generally pointed directly toward oncoming traffic, and will not be seen by traffic on side streets, thus minimizing the need for shielding the output light from the LEDs. Thus, the light emitted from such LEDs is more efficiently utilized compared with the light emitted from contemporary, e.g., non-jumbo LEDs, or LED clusters which have larger radiation pattern angles.

Integrated timer circuit 43 provides an output LED drive signal which facilitates illumination of the LEDs 45*a*–45*h* such that the LEDs 45*a*–45*h* are illuminated according to a desired duty cycle and a desired on time. The integrated circuit timer 43 preferably comprises a TLC 555 ceramic metal oxide substrate (CMOS) integrated circuit. The TLC 555 integrated circuit timer has a current drain of only 14 mA when used with eight LEDs which are turned on simultaneously and 1.3 mA with the LEDs turned off. The LED cathode voltage is 0.92 volts with the LEDs on and 12.32 volts with the LEDs off.

According to the preferred embodiment of the present invention, the LEDs 45*a*–45*h* are mounted about the periphery of a stop sign 46. Further, according to the preferred embodiment of the present invention, a first LED branch circuit 48 and a second LED branch circuit 49, each branch containing four LEDs in series and each branch in parallel with each other branch, provide electrical interconnection of the LEDs 49*a*–49*h* with the integrated timer circuit 43. Current limiting resistors 47 and 48 limit current flow through the LED branch circuits 48 and 49, respectively. Thus, each branch circuit 48 and 49 is connected in series with a 120 ohm resistor so as to provide the desired current flow, e.g., approximately 20 mA through each LED branch circuit 48 and 49.

However, those skilled in the art will appreciate that various different circuit configurations of the LEDs are suitable. For example, integrated time circuit 43 can operate at least six LEDs in a given branch circuit, but by increasing the branch resistor 47 or 48, the number of LEDs in the branch circuit could be decreased down to only one LED. It may also be useful to utilize one or more self-blinking LEDs to effect the blinking cycle without requiring a timer circuit. Thus, for example, all of the LEDs may alternatively be configured in a single serial chain or, alternatively, each of the LEDs may be placed in parallel with one another.

Resistors 40 and 41 define the duty cycle and on time of the LEDs 45*a*–45*h*. According to one preferred embodiment of the present invention, resistor 41 comprises a 386K resistor and resistor 40 comprises a 118K resistor. These resistance values for resistors 40 and 41 define a duty cycle of approximately 20 percent with an on time of approximately 0.25 second. Of course, varying the values of resistors 40 and 41 facilitates changes in the duty cycle and on time such that various different combinations thereof may be obtained, as desired. Indeed, variable resistors, such as the Bourns 3386 ⅜-inch square metal cermet resistor may alternatively be used in place of resistors 40 and 41 so as to facilitate convenient manual changing of the duty cycle and on time.

In order to provide a 50 percent duty cycle per the *Manual of Uniform Traffic Devices*, or MUTCD guideline published by the United States Federal Highway Commission for red blinking lights on a stop sign located at a remote intersection, and to provide an on time of approximately one second, the resistances of resistors 41 and 40 should be approximately 60K and 600K, respectively.

It is important that resistor 41 have a resistance of at least 10K, in order to prevent undesirable damage to integrated circuit timer 43.

Resistor 40 and capacitor 37 cooperate to determine the on time of the LEDs 45*a*–45*h*. The series combination of resistors 40 and 41 with the capacitor 37 determines the off time of the LEDs 45*a*–45*h*. The blinking cycle time is the sum of the on and off times. The capacitor 38 prevents parasitic oscillation of the integrated circuit timer 43.

According to one preferred embodiment of the present invention, the control circuit is configured so as to facilitate compliance with the MUTCD guideline which specifies that the preferred blink cycle for red blinking lights mounted on stop signs at remote intersections as one second on and one second off, equivalent to a 50 percent duty cycle and an on time of one second.

The solar panel output voltage is used to turn the integrated circuit timer 43 on and off, using the high-gain Darlington transistor pair 34 and 35 for the switching function. These high-gain transistors 34 and 35 ensure that there is no instability in the electrical switching function, so that the LED blinking cycle is either turned fully on or fully off. The use of this Darlington pair 34 and 35, and aiming the solar panel such that it is pointed substantially directed upward, tends to mitigate any tendency for vehicle headlights to cause the blinking timer circuit to be undesirably disabled at night such that the LEDs 45*a*–45*h* fail to blink as a result of automobile headlights. This arrangement provides a substantial advantage in that no separate photocell or photodetector is needed to provide an ambient light-sensing function, since this function is provided by the solar panel itself according to the present invention.

Zener diode 32, in cooperation with resistor 31, determines the output voltage of solar panel 20 which causes the blinking cycle of the LEDs 45*a*–45*h* to cease.

Mercury tilt switch 56 and fuse 57 cooperate to provide a simple and effective means of disabling the control circuit, so as to prevent further functioning of the LEDs 45*a*–45*h* in the event of theft or vandalism. Preferably, the mercury tilt switch 45 is configured such that tilting of more than approximately 30 degrees from the vertical results in closing thereof. Closing of the mercury tilt switch 56 effects a direct short across the terminals of battery 21, thereby causing fuse 57 to blow. Further operation of the LEDs 45*a*–45*h* will not occur until the fuse 57 is replaced.

Figure 4:
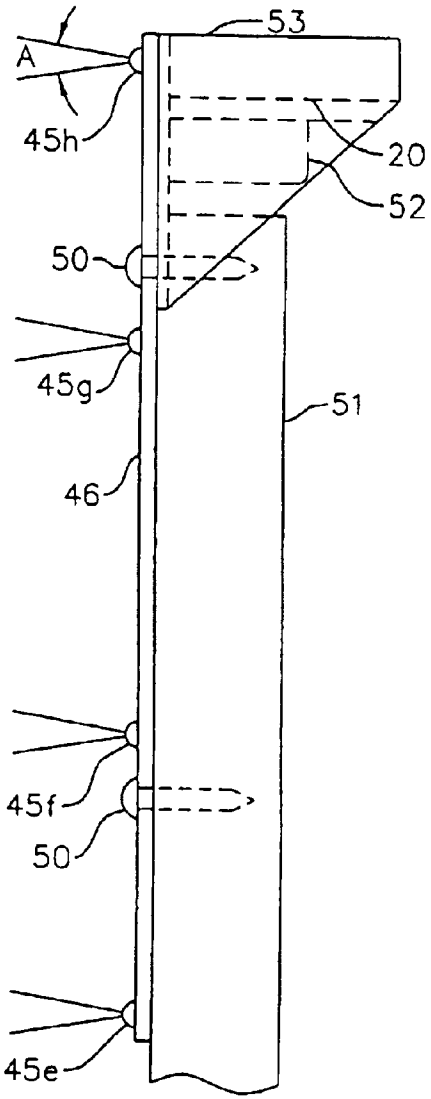
FIG. 4 is a side view of the exemplary traffic control sign of FIG. 3.
Figure 3:
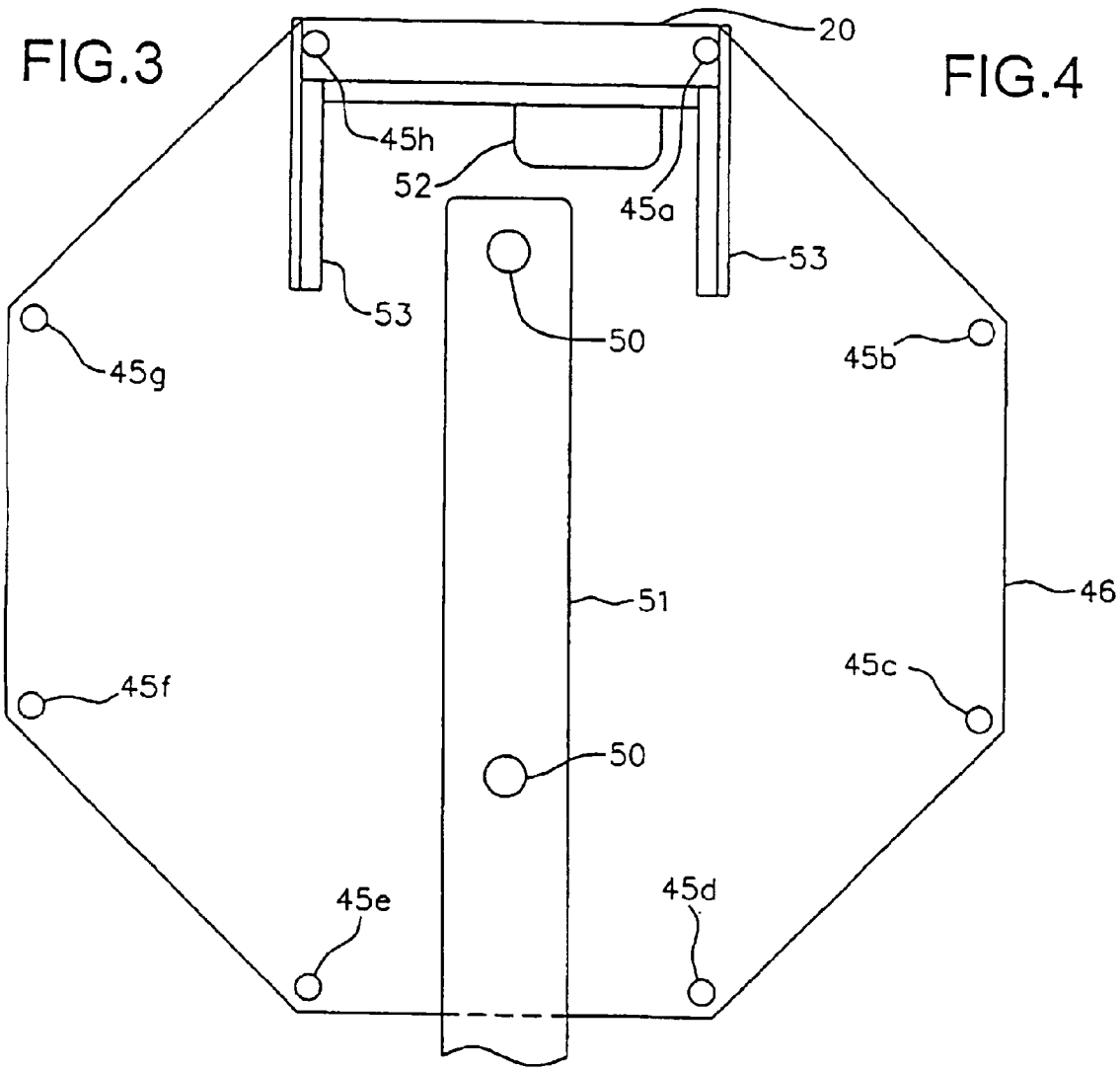
FIG. 3 is a rear view of an exemplary traffic control sign having a plurality of LEDs mounted thereupon according to the present invention.

Referring now to FIGS. 3 and 4, mounting of the LED drive circuitry and the battery charging circuitry, according to the present invention, is shown. The battery, solar panel, and control circuitry is preferably mounted upon the back of the stop sign as shown in FIGS. 3 and 4.

Discussion and illustration of the present invention as a stop sign is by way of example only and not by way of limitation. Those skilled in the art will appreciate the various other embodiments or implementations of the present invention are likewise suitable.

Each of the LEDs 45*a*–45*h* are also preferably mounted to the back of the stop sign and preferably extend therethrough. The LEDs 45*a*–45*h* are mounted about the periphery of the stop sign 46. It is preferred that eight LEDs 45*a*–45*h* are mounted, one at each of the eight vertices of the stop sign. The stop sign 46 is attached, via threaded fasteners 50 such as bolts, screws, or any other desired fasteners to pole 51. The LED drive circuitry, rechargeable battery, and battery charging circuitry of FIG. 2 is preferably contained within housing 52, which is attached to the sign 46 via brackets 53. The solar panel 20 is also attached to the stop sign 46 via brackets 53. It should be noted that solar panel 20 can also be mounted remotely, for example at the top of extended mounting pole 51, in which case the rechargeable batteries and control circuits can be contained in a small business 52. The housing 52 is preferably not more than ¾-inch thick when mounted on the back surface of sign 46.

With particular reference to FIG. 4, the LEDs have a radiation pattern having an angle, Angle A (better shown in FIG. 5), less than approximately 20 degrees, preferably less than approximately 10 degrees. Indeed, as discussed above, the LEDs may have a radiation pattern angle less than approximately 4 degrees.

Figure 5:
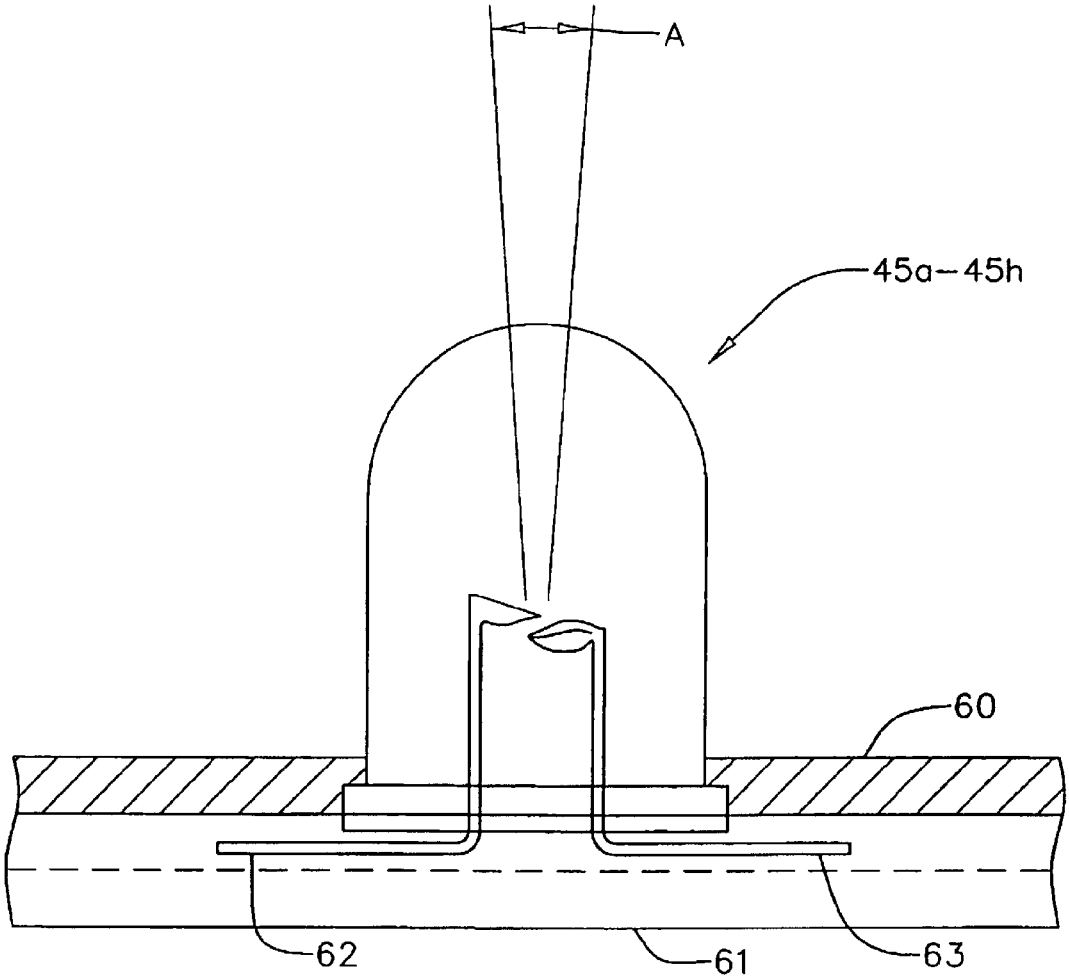
FIG. 5 is an enlarged side view, partially in cross section, showing a single LED mounted to the traffic control sign of FIG. 3 and showing the radiation pattern angle of the LED.

Referring now to FIG. 5, each LED provides illumination with a radiation pattern having an angle, Angle A, as discussed above. Each LED 45*a*–45*h* has a pair of leads 62 and 63 for providing electrical power thereto. According to the present invention, the leads 62 and 63 are at least ⅜ of an inch long, so as to mitigate damage to the LEDs 45*a*–45*h*, which may otherwise occur during assembly of the present invention, when the LEDs are soldered in place.

Figure 6:
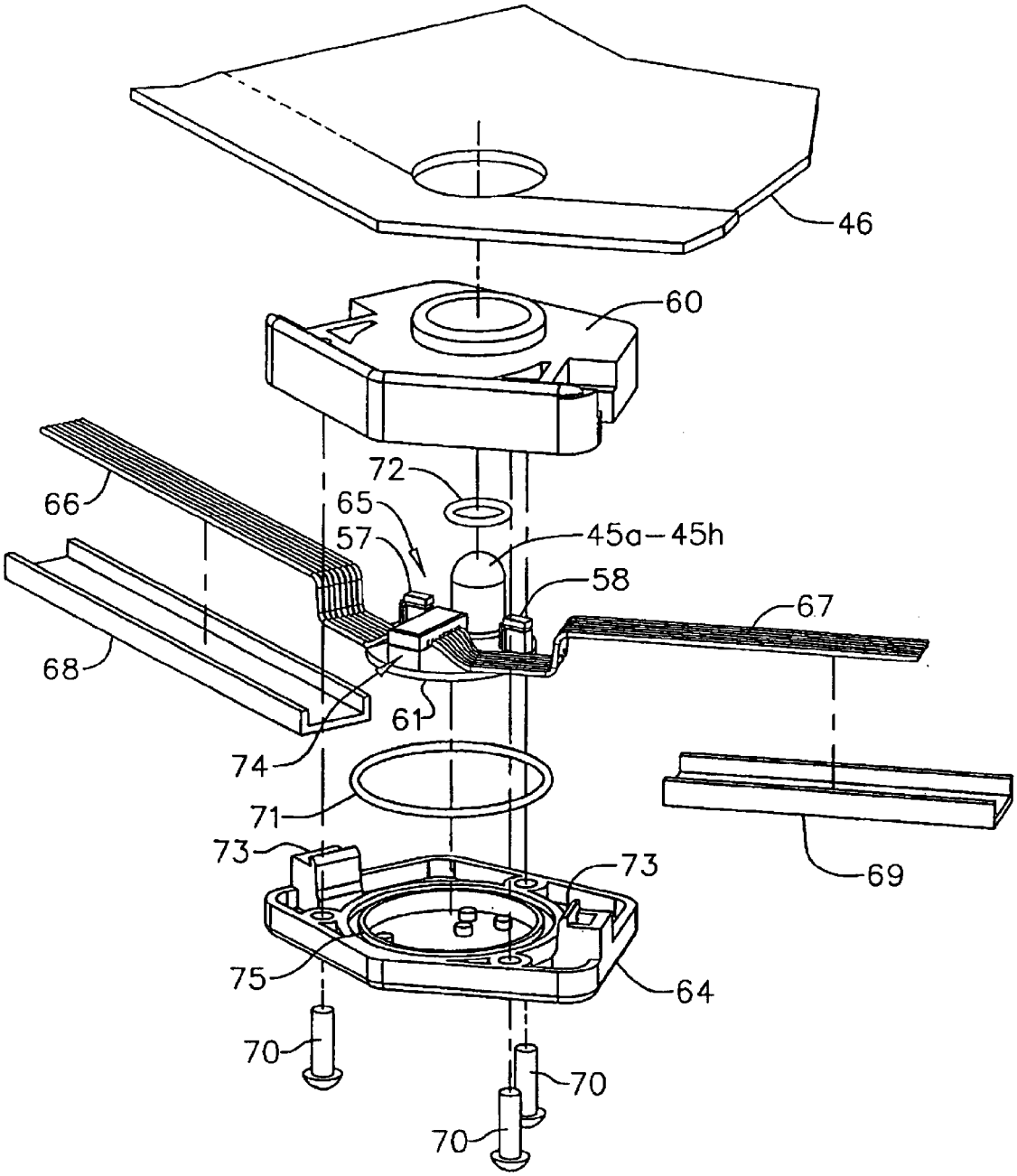
FIG. 6 is an exploded perspective view of an LED control module having a single LED and also having conductive conduits extending therefrom, so as to effect control of the plurality of other LEDs mounted upon the traffic control sign.

Referring now to FIG. 6, the LED housing comprises upper housing section 60 and lower housing section 64, within which a portion of each LED 45*a*–45*h* and the LED mount plate 61, as well as the LED drive circuitry 65 of FIG. 2 are disposed. Ribbon cables 66 and 67 provide electrical interconnection between LED drive circuitry 65 and other LEDs which are similarly contained within water-resistant housings. Thus, only one water-resistant housing, such as that shown FIG. 6, needs to contain the LED drive circuitry 65 while the other water-resistant housings merely contain the remaining LEDs and provide electrical connection thereto. Alternatively, LED drive circuitry 65 and rechargeable battery, preferably NiMH type, can be contained in a separate enclosure mounted to the back of stop sign 46. It is preferred that all components extend not more than 0.75 inches from back surface of stop sign 46, except fro the solar panel. Electrical connection between ribbon cable 66 and 67 and LEDs 45*a*–45*h* is preferably effectuated using insulation displacement connector, or IDC, connector 74.

Trays 68 and 69 preferably cover ribbon cables 66 and 67, so as to provide protection therefor. Cable trays 68 and 69 are sufficiently rigid to provide protection to the ribbon cables 67 and 69 enclosed therein. Ribbon cables 66 and 67 preferably contain eight conductors typically 28 AWG stranded type, enclosed by insulation on 0.050 inch centers.

Use of the water-resistant enclosure defined by upper section 60 and lower section 64 and the cable trays 68 and 69 substantially reduce the likelihood of undesirable damage during shipping and handling, as well as reduce the likelihood of damage from vandalism or from intrusion of water into the electrical parts.

Ribbon cables 66 and 67 thus provide for the independent connection of up to four LEDs each to the control circuit, such that each such LED may be independently controlled by the control circuit and independently tested thereby. Those skilled in the art will appreciate that the control circuit and cables 66 and 67 may be configured to accommodate any desired number of LEDs.

Optionally, some or all of the ribbon cables 66 and 67 and the cable trays 68 and 69 are secured to the back of the stop sign 46 via VHB tape sold by the 3M Company or any other desired bonding or affixing material.

Pin selectors 57 and 58 define the desired sequential connections between the eight conductor ribbon cables 69 and 67, respectively, and may optionally provide connection between LED leads 62 and 63 of FIG. 5 and the desired positive or negative conductor in each ribbon cable 69 and 67. Each of the pin trees associated with the pin selectors 57 and 58 has four possible positions, thereby providing optional connections to all eight conductors in the preferred embodiment of the present invention.

Attachment of the lower section 64 to the upper housing section 60 preferably effects substantially deforming of the ribbon cables 67 and 69 such that they are caused to compress and bend around forms 73 which function as a cable restraint and thereby prevent damage to the LED drive circuitry 65 in the event that one of the ribbon cables 67 or 69 is inadvertently pulled or displaced. Compression of the ribbon cables 67 and 69 intermediate the upper housing section 60 and the outer 0-ring seal 71 contained in groove 75 within lower housing section 64 inhibits the undesirable introduction of water into the housing.

A plurality of threaded fasteners, such as screws 70 attach the lower housing section 64 to the upper housing section 60 and may also attach the assembled upper and lower housing section 60 and 64 to the rear of the stop sign 46. Alternatively, the assembled housing may be attached to the stop sign 46 via any other desired means, e.g., adhesive bonding, press fit, other fasteners, etc. Outer O-ring seal 71 provides a water-resistant seal between the upper housing 60 and the lower housing section 64 as upper housing 60 and lower housing 64 are compressed together by fasteners 70. Similarly, LED O-ring seal 72 provides a water-resistant seal between LEDs 45*a*–45*h* and the upper housing section 60, where the LED 45*a*–45*h* extends through the upper housing section 60, so as to be visible from the front of the stop sign 46.

Thus, according to the preferred embodiment of the present invention, the LEDs 45*a*–45*h* are each mounted in a small, waterproof enclosure so as to enable any one of several LEDs mounted on a traffic sign to be inspected, removed or replaced as may be desired from time-to-time without disturbing any of the remaining LEDs 45*a*–45*h*. Replacement of LEDs 45*a*–45*h* may be accomplished by detaching IDC connector 74 from ribbon cables 66 and 67 and then re-attaching another IDC connector 74 with new LED mount plate 61 to ribbon cables 66 and 67.

According to the preferred embodiment of the present invention, the LEDs are thus mounted in a waterproof enclosure such that the output light beam therefrom is aimed approximately perpendicular to the flat surface defined by the stop sign 46. Alternatively, the enclosure defined by the upper enclosure section 60 and lower enclosure section 64 is mounted directly to a generally planar surface and the generally planar surface is then mounted to the stop sign.

Figure 7:
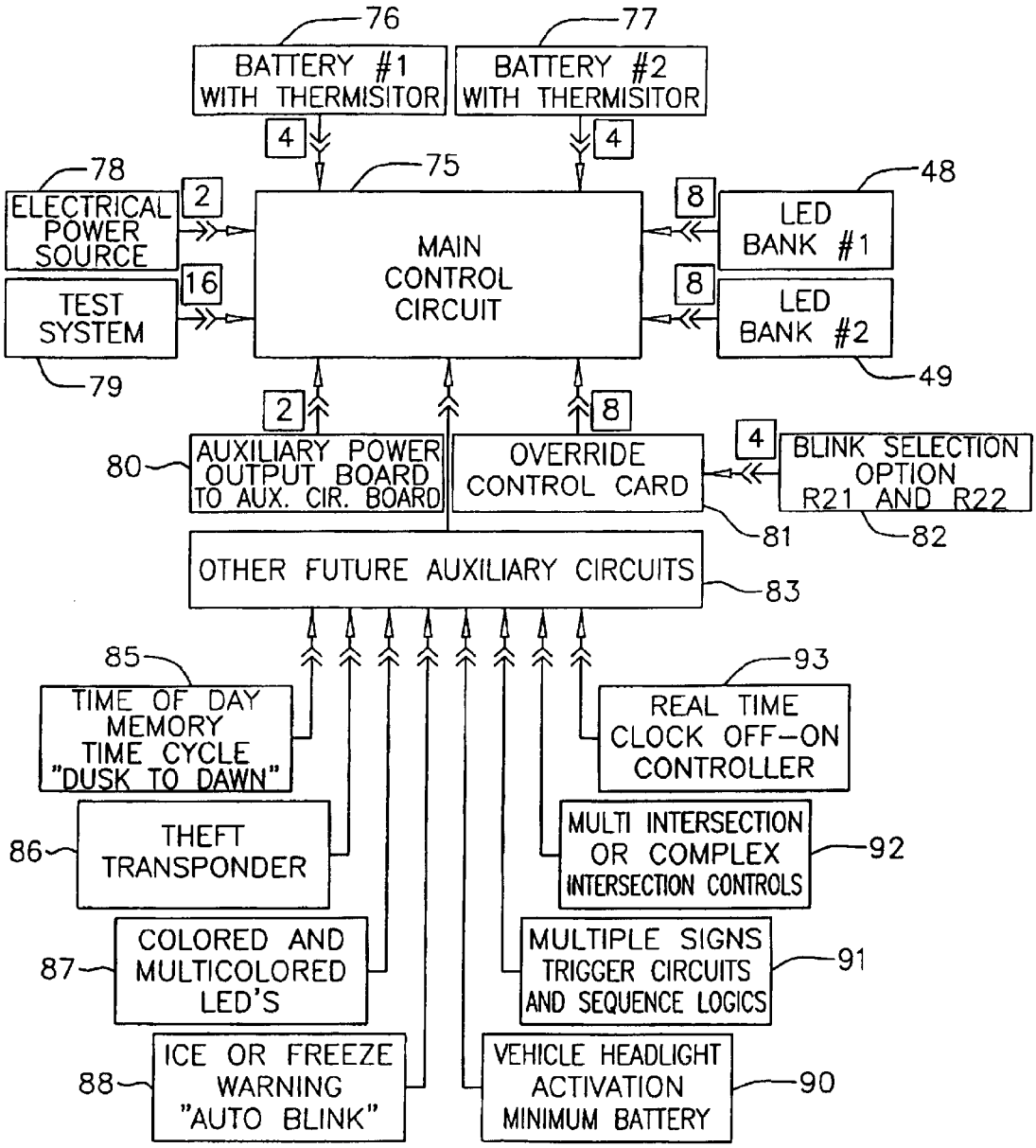
FIG. 7 is a block diagram of an enhanced configuration of the enhanced visibility traffic control sign of the present invention, having a plurality of optional circuits for enhancing the utility thereof.

Referring now to FIG. 7, according to an alternative configuration, the present invention comprises a main control circuit 75 to which a plurality of other circuits may be electrically connected. The main control circuit 75 comprises the integrated circuit timer 43 of FIG. 2 and defines the control circuitry for the LEDs 45*a*–45*h*. Batteries 76 and 77 are electrically connectable to the main control circuit 75, so as to provide power for the LEDs 45*a*–45*h*. Alternatively, any desired external electrical power source 78 may be utilized, such as a solar panel or other low voltage DC power source.

Preferably, the LEDs comprise two banks 48 and 49, each having LEDs connected in series and the banks are connected in parallel as shown in FIG. 2.

Optionally, a test system 79, discussed in detail below, may be electrically connected to the main control circuit 75 in order to effect testing of the LEDs 45*a*–45*h*, batteries 76 and 77, the power source 78, as well as any desired control circuitry.

Auxiliary power output board 80 provide output power to other devices, as desired.

Override control card 81 facilitates control of the LEDs 45*a*–45*h* via any desired source other than the internal LED control circuitry of FIG. 2. Thus, for example, the LEDs may be controlled by external environmental sensors, such as an ice or freeze sensor or remotely from an emergency vehicle, as discussed in detail below.

Blink selection option 82 facilitates changing of the duty cycle and/or on time.

Other future auxiliary circuits interface 83 facilitates the electrical connection of a variety of other optional features, as discussed in detail below.

Time-of-day memory time cycle 85 comprises an ambient light sensor and a timer such that illumination of the LEDs 45*a*–45*h* may be controlled with respect to a dusk-to-dawn cycle. For example, the LEDs may be preprogrammed so as to begin illuminating one hour prior to dusk and to cease illuminating one hour after dawn. In this manner, illumination of the LEDs is dependent upon the times of sunrise and sunset, but frequent reprogramming due to variations in these times is not necessary.

Theft transponder 86 provides a signal, which may be detected by a local police department, in the instance that the illuminated stop sign of the present invention is moved, e.g., stolen. The signal is preferably provided via a wireless or radio frequency link. However, any other suitable signal, such as an audible alarm signal, may similarly be utilized.

Colored and multi-colored LEDs 87 may optionally be used to facilitate communication of more complex messages or to enhance the capability of the present invention to attract attention.

Ice or freeze warning 88 provides an autoblink or increased blink rate when a temperature sensor senses a temperature drop below a predetermined threshold, such that ice is likely to form upon the roadway so as to present a hazard to nearby motorists. The increased blink rate will draw enhanced attention to the stop sign.

Vehicle headlight activation minimum battery 90 comprises an optional circuit for sensing the presence of an approaching vehicle, such as a photosensor (for sensing headlights), a radar sensor, an ultrasonic sensor, or any other desired sensor. The LEDs 45*a*–45*h* are only activated when an approaching vehicle is sensed, to conserve battery power.

Multiple signs trigger circuits and sequence logics 91 provides control circuitry so as to facilitate illumination of LEDs upon a plurality of different signs in any desired manner. For example, a dangerous curve in the roadway may be indicated by a blinking sequence of arrows formed upon a sign.

Multi-intersection or complex intersection controls 92 provide control circuitry so as to cause a plurality of separate traffic control signals to cooperate with one another such that traffic at a plurality of different intersections or from a plurality of different signs at a single intersection regulate traffic in a desired manner.

Real time clock on/off controller 93 facilitates illumination of the LEDs 45*a*–45*h* according to a predetermined schedule which does not depend upon the presence or absence of ambient lighting. Thus, for example, the LEDs may be pre-programmed so as to initiate illumination at 7:00 p.m. each evening and so as to cease illumination at 7:00 a.m. each morning.

Figure 8:
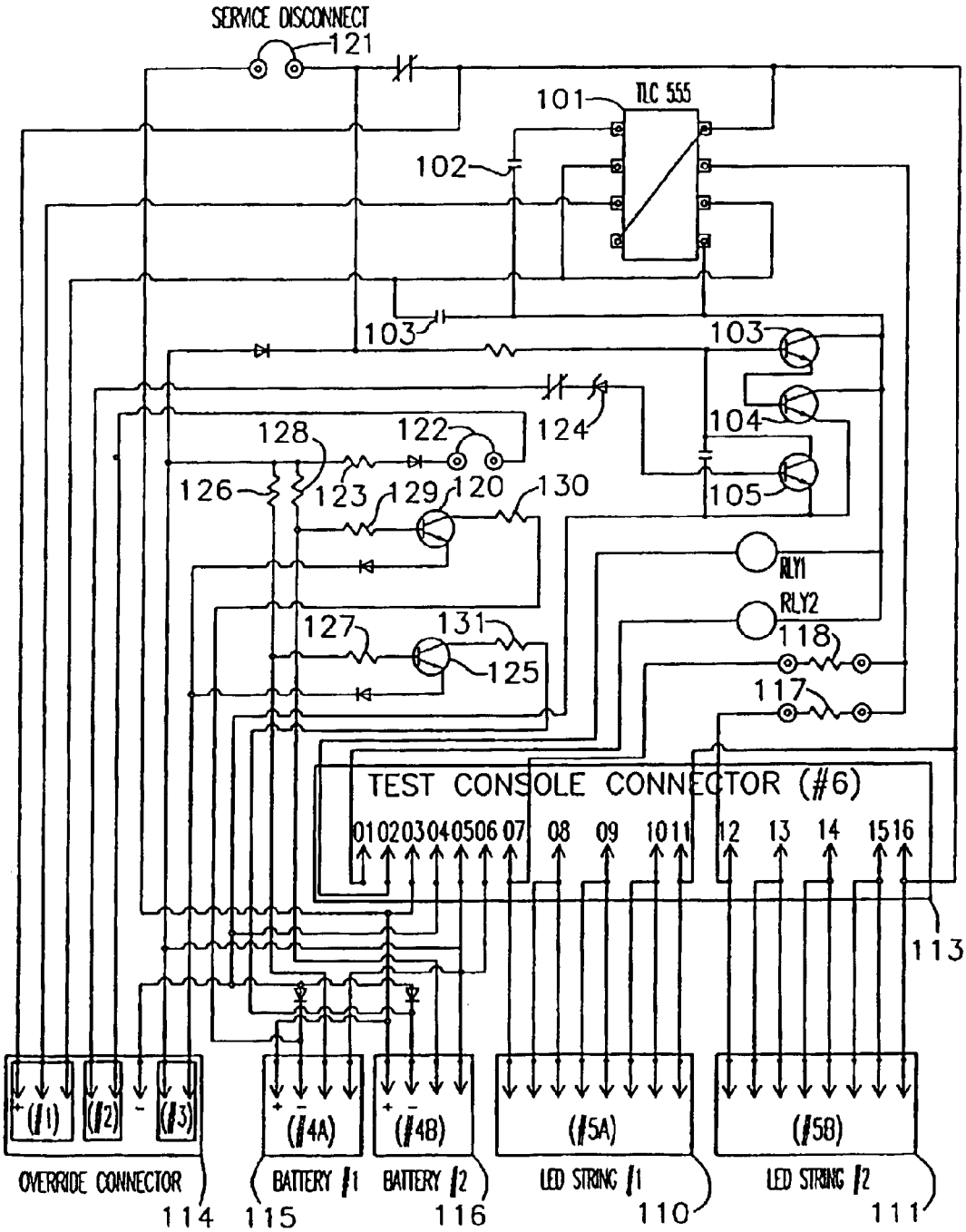
FIG. 8 is an electrical schematic of the main control circuit of FIG. 7.

Referring now to FIG. 8, an electrical schematic for implementing features shown in the block diagram of FIG. 7 is provided. As in the electrical schematic of FIG. 2, integrated circuit timer 101 provides an output for driving LEDs according to a desired duty cycle and on time. Preferably, two branch circuits of LEDs, via LED string 1 connector 110 and LED string 2 connector 111, are utilized.

Figure 9:
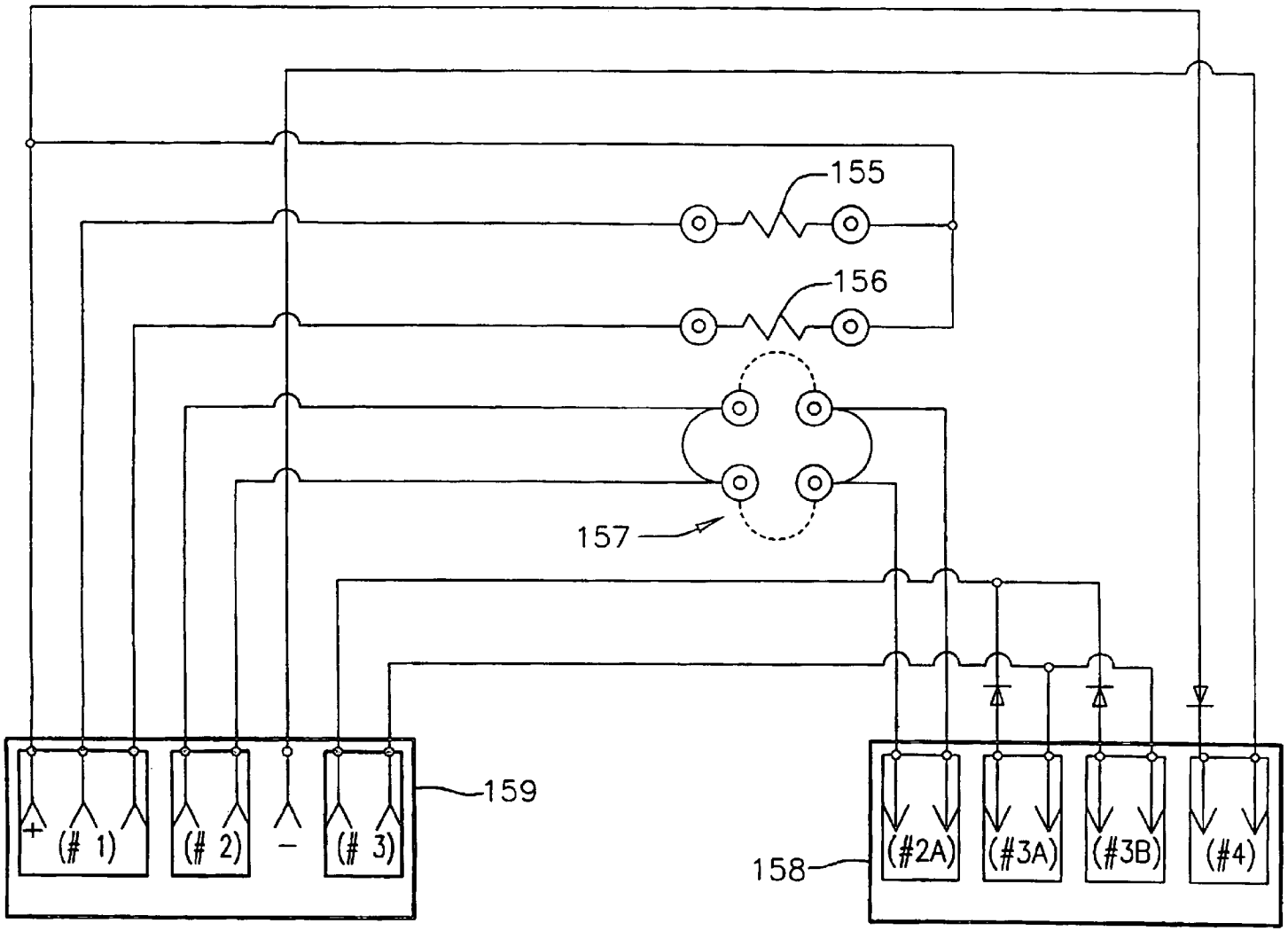
FIG. 9 is an electrical schematic of an auxiliary override circuit according to the present invention.

Resistors 155 and 156 in FIG. 9 which are connected via connector 1 of override connector 114 facilitate the definition of a desired duty cycle and on time for the LEDs. Also, transistors 103, 104 and 105 cooperate so as to facilitate operation of the integrated circuit timer 101 without undesirable oscillation. Resistor 123 and zener diode 124 in cooperation with transistor 105 and interrupt switch 151 in FIG. 9 are connected by connector 2 in override connector 114 to facilitate operation of the LEDs only during a period of low illumination, as discussed in detail above.

One important aspect of the electrical schematic of FIG. 8 is the use of plug-in connectors 110, 111, 113, 114, 115 and 116. These plug-in connectors 110, 111, 113, 114, 115 and 116 facilitate the use of a common control circuit for a variety of different LED traffic sign applications.

Thus, according to the present invention, the 8-conductor auxiliary override connector 114 may be utilized to control the duty cycle and on time via connections 1 thereof; to force the LED blink cycle to commence upon demand via connection 2 thereof; and to provide power from a remote DC power supply, such as a solar panel via connector 3 thereof.

Connector 115 facilitates the connection of a first battery thereto via the plus and minus terminals thereof and the connection of a thermistor via the other two terminals thereof. Similarly, connector 116 facilitates the use of a second battery and thermistor, if desired. LED string number 1 connector 110 facilitates the attachment of an 8-conductor LED ribbon connector which may facilitate electrical connection to from one to four individual LEDs. The current in each LED string is preferably adjusted to 20 mA via balancing resistors 117 and 118 which are preferably mounted so as to facilitate easy changing thereof.

The 16-conductor test console connector 113 facilitates both operational and maintenance testing as described in further detail below.

Removal jumpers or pin selectors 121 and 122 facilitate further control of the LEDs. When removal pin selector 121 is removed, then the main control circuit is completely disabled and the LEDs will not illuminate. When removable pin selector 122 is removed, then the LED blinking cycle is forced to turn on.

As mentioned above, electrical power may optionally be provided via a solar panel or other external power source by electrical connection to connection 3 of override connector 114. When sufficient ambient light is available, then the solar panel input voltage, which is provided through resistor 123 is sufficient to cause zener diode 124 to conduct, thereby causing transistor 105 to shunt voltage away from Darlington transistors 103 and 104. When voltage is shunted away from Darlington transistors 103 and 104, then insufficient voltage is provided to the IC timer 101 to maintain triggering of the LED blink cycle and the LED blink cycle therefore ceases. Thus, at night, in darkness or in adverse weather conditions zener diode 124 overcomes the reduced solar panel output voltage and transistor 105 no longer shunts voltage away from the Darlington transistors 103 and 104, thus facilitating triggering of the LED blink cycle via integrated circuit timer 101. Removing pin selector 122 has a similar effect by interrupting the function of transistor 105 so as to shunt voltage away from the Darlington transistors 103 and 104.

Transistors 120 and 125 in combination with resistors 126–131 provide the same battery charging and regulating functions as the corresponding components shown in FIG. 2. However, since the electrical schematic of FIG. 8 contemplates the optional use of two batteries (attached via electrical connectors 115 and 116) and since the associated regulating thermistors are not located on the main control board, but rather are preferably located inside the battery packs themselves, provision is made for the interconnection of the batteries and the thermistors via electrical connectors 115 and 116.

Referring now to FIG. 9, a preferred embodiment of the auxiliary override circuit is provided. Connector 159 is electrically attached to override connector 114 in FIG. 8. Resistor 155 and resistor 156, which are preferably both mounted so as to be easily replaceable, are optionally used to adjust the LED on time and duty cycle, respectively. As those skilled in the art will appreciate, the use of several banks of such resistors, combined with override transponder relays on the auxiliary override circuit would allow override of the LED blink cycle so as to facilitate the use of an increased blink rate, e.g., two or three times that of the normal blink rate, in order to alert motorists to emergency conditions.

Jumper assembly or pin selector 157 may be removed from the pin tree so as to force the LED blinking cycle to commence. A number of different methods for remotely activating a relay on the auxiliary override circuit so as to force the LEDs to start blinking or to blink at different rates using a relay device to optionally select from a number of pairs of resistors 155 and 156 are contemplated, as mentioned above and discussed in detail below.

External electrical power is provided from a solar panel or other external DC power source via connections 3*a* and/or 3*b* of connector 158. Connection number 4 of connector 158 facilitates the addition of an auxiliary power output connector so as to facilitate the provision of electrical power to any other desired device. Connection 2*a* is an auxiliary connection to other optional means for forcing the LED blink cycle to start. For example, it may be desirable to provide a radio frequency or other wireless means for initiating the blink cycle, so as to allow emergency vehicles to control traffic. Further, external sensors, such as a freeze or ice warning sensor may attached so as to cause the LEDs to blink when the temperature falls below a predetermined threshold value.

Figure 10:
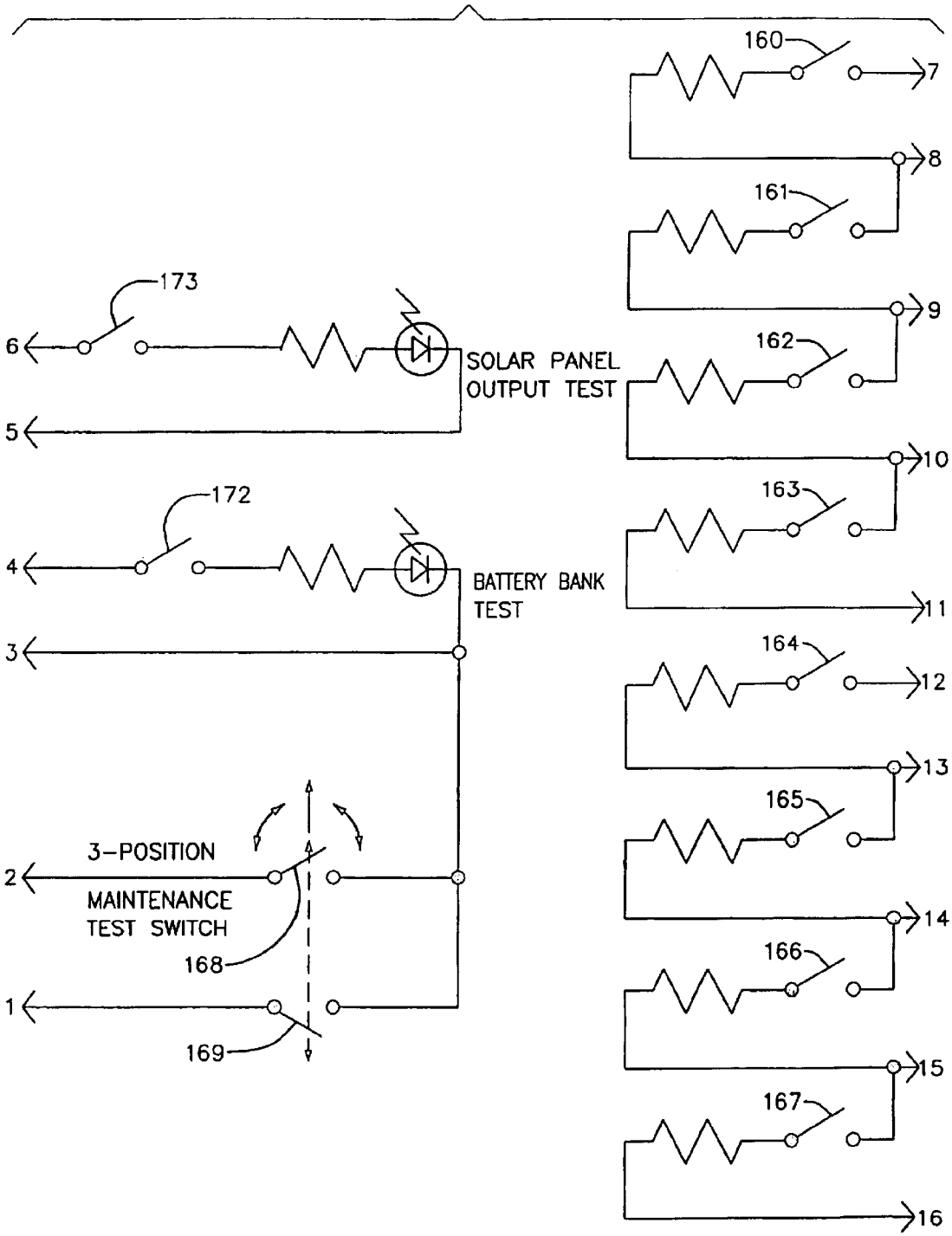
FIG. 10 is an electrical schematic showing maintenance and test circuitry associated with the block diagram of the enhanced utility traffic control sign of FIG. 7.

Referring now to FIG. 10, a test system circuit is used to test the independent functioning of each individual LED 45*a*–45*h* (FIG. 2), the solar panel output, and the batteries. Connections 1–16 are electrically connected to the test console connector 117 of FIG. 8 using suitable connection means. Connections 7–11 corresponding to test switches 160–163 are used to individually test each LED in LED string 1 (48 of FIG. 2). Likewise, connections 12–16, corresponding to test switches 164–167 are used to individually test each of the LEDs in LED string 2 (FIG. 2). The switches 160–167 may be operated manually, automatically via mechanical means, or may be computer or otherwise electronically controlled.

If any particular LED in one of the two LED strings fails, then all of the rest of the LEDs in that string will cease blinking. A common problem is to determine which of the LEDs in a string has failed, so as to facilitate only replacement of the failed LED. The test system circuit of the present invention shown in FIG. 10 facilitates such individual testing of the LEDs. In order to facilitate such individual testing of the LEDs, the 3-position maintenance switch 168 is used. The three positions correspond to (a) always blink, (b) normal operation and (c) disconnect. The 3-position maintenance switch 168 is moved to "always blink" to force the LED blinking cycle to start. Then, if there is a failed LED, the failed LED string may be observed.

When the test switch 160–167 for a particular LED is closed, then that LED is bypassed. If the bypassed LED is the failed LED, then the rest of the LEDs on the failed LED string will commence blinking. If the LED corresponding to the closed switch is not the failed LED, then none of the LEDs on that particular LED string will blink. Thus, if there are no failed LEDs on either LED string, then only that particular LED being tested will stop blinking when the associate LED test switch 160–167 is closed.

By selecting each of the LED test switches 160–167 in sequence, it is thus a simple matter to find any failed LED when all of the rest of the LEDs on that particular LED string resume blinking. If there is more than one failed LED, then the test switch for each failed LED must be used before the remaining LEDs will begin blinking again. If there are no failed LEDs, then circuit continuity and integrity can easily be verified by turning off each of the blinking LEDs in sequence utilizing the LED test switches.

Switch 168 and 169, taken together, preferably define a 3-position maintenance test switch wherein in a first position switch 168 is closed and switch 169 is open. In a second position, both 168 and 169 are open and in a third position, 168 is open and 169 is closed. In the first position (168 closed and 169 open), the LEDs 45*a*–45*h* blink continuously. In the second position, (both 168 and 169 open), the control circuit operates normally, i.e., the LEDs illuminate when ambient light falls below a predetermined threshold value and the LEDs blink with a duty cycle and on time as defined by the integrated circuit timer 43 and associated circuitry. When the test maintenance switch is in the third position (switch 168 is open and switch 169 is closed), then the control circuit is disabled and all batteries and external power supplies are disconnected therefrom.

According to the preferred embodiment of the present invention, the test system circuit is mounted in a hand-held test console which can be manually plugged into the test console connector 113 of the main control circuit board of FIG. 8 using a 16-pin connector. For example, a 16-conductor ribbon cable, typically approximately six feet long, may be utilized to effect such electrical interconnection. After plugging the 16-pin connector into the main control circuit board, a technician may then stand in front of the enhanced visibility traffic signal of the present invention and effect desired testing thereof. Thus, the LEDs, solar panel and/or batteries may be tested as described above.

Switch 172 facilitates the testing of the battery for proper voltage. Switch 173 facilitates the testing of the solar panel for proper output during normal daylight conditions or, an external low voltage DC power source can be tested. Thus, the test circuit of FIG. 10 allows a test technician to rapidly and efficiently perform all tests necessary to verify proper operation and/or identify maintenance requirements for one or more enhanced visibility traffic signals of the present invention.

Figure 11:
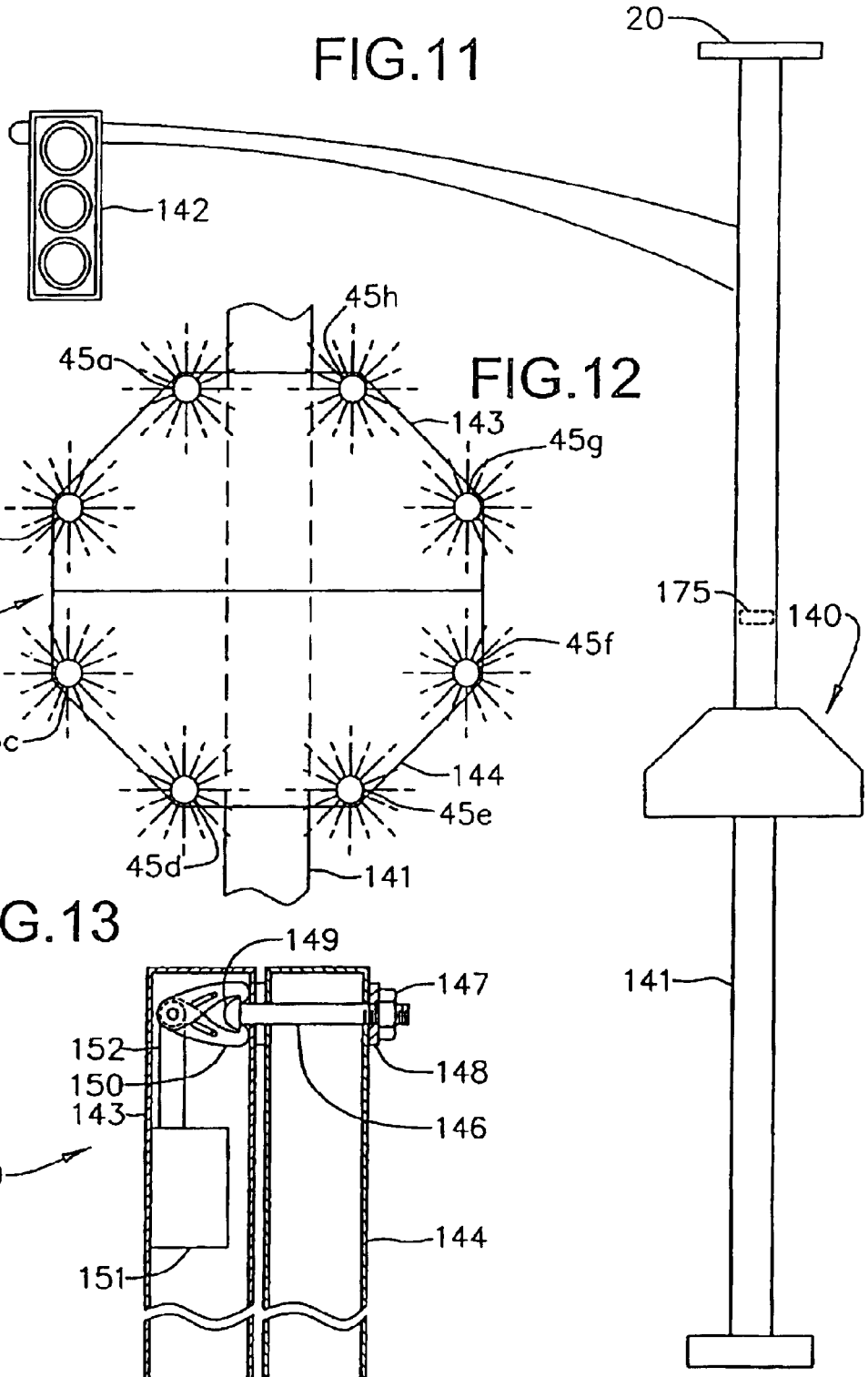
FIG. 11 is a front view of a pole-mounted stop light having a stop sign attached thereto such that the stop sign will be displayed if power to the stop light is interrupted, showing the stop sign in the stowed configuration.
Figure 12:
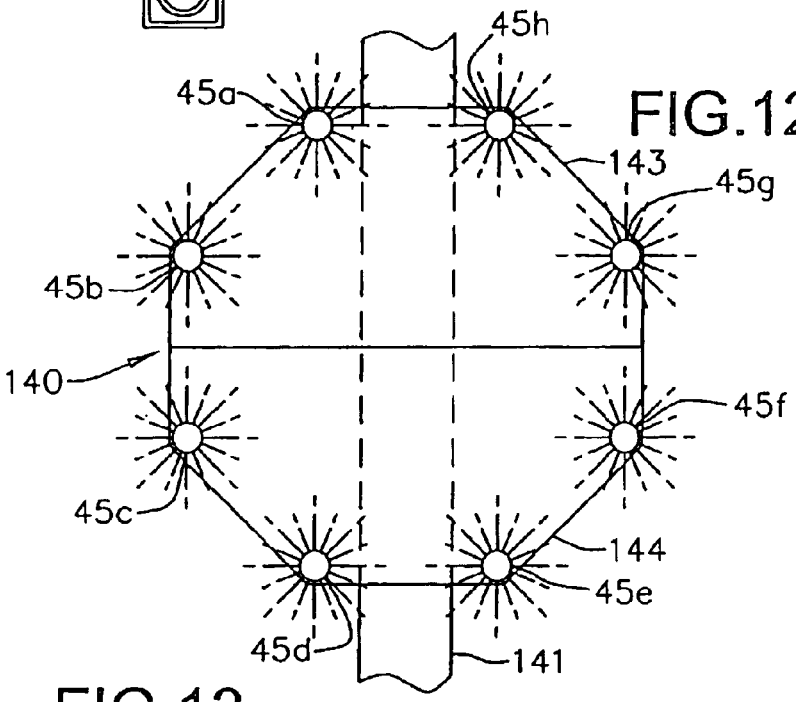
FIG. 12 is an enlarged view of the stop sign of FIG. 11, showing the stop sign in the deployed configuration thereof.
Figure 13:
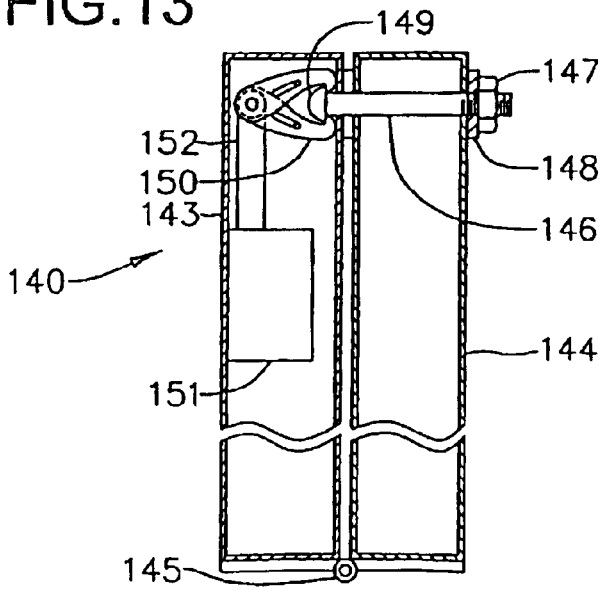
FIG. 13 is a cross-sectional side view of the stop sign of FIG. 12, showing the mechanism for holding the stop sign in the stowed position thereof.

Referring now to FIGS. 11–13, the present invention optionally comprises a fail-safe stop sign 140 configured so as to actuate or provide a traffic indication in the event of power loss or other emergency condition. Thus, for example, this optional configuration of the present invention comprises a stop sign.

Thus, a sign, such as stop sign 140, is configured so as to be displayed in the event of loss of power. Thus, for example, for such stop signs 140 may be provided at a 4-way intersection such that in the event of loss of power and the consequent non-functioning of the traffic lights, each of the stop signs is displayed, so as to define a 4-way stop, or alternatively, for example, a required stop on side streets to a main highway. In this manner, the likelihood of traffic accidents is mitigated desirably.

Although a deployable stop sign is discussed and illustrated herein, those skilled in the art will appreciate that various other deployable signs are likewise desirable. Thus, the use of a deployable stop sign is by way of example only and not by way of limitation.

Thus, according to this aspect of the present invention, a current detector monitors current provided to the traffic signal light, which should always be present since one of the three, i.e., red, yellow or green, lights should always be illuminated at any given instant. Thus, when no current is present, as may be easily detected on the common or return line from the signal lights, then it is reasonable to assume that a power failure has occurred and that the definition of a 4-way stop via the deployable stop signs is appropriate.

With particular reference to FIG. 11, the deployable stop sign 140 is disposed upon a pole 141, which is preferably the same pole that traffic signal light 142 is disposed upon. Those skilled in the art will appreciate that the deployable stop sign 140 of the present invention may similarly be mounted to any other structure.

With particular reference to FIG. 13, the deployable stop sign 140 comprises upper stop sign section 143 which is rigidly attached to the pole 141 and lower stop sign section 144 which is pivotally attached, via hinge 145, to upper stop sign section 143. Hinge 145 preferably contains a hinge spring to open upon deployment.

According to the preferred embodiment of this aspect of the present invention, a detent member comprises a bolt 146 attached to the lower stop sign section 144 via nut 147 and washer 148. The bolt head 149 is captured by a release mechanism 150, which is contained within the upper stop sign section 143. Alternatively, it is preferred that release mechanism 150 is attached to pole 141 using the same mounting bracket which is used to mount upper stop sign section 143.

Release actuator 151, preferably comprising a 12-volt DC solenoid or actuator is coupled to effect holding of the detent defined by the head 149 of bolt 146 as long as power is applied to the solenoid or actuator 151. When power is provided to solenoid or actuator 151, then the resulting movement causes linkage 152 to effect release of the detent defined by the head 149 of bolt 146 by the release mechanism 150.

Thus, when a power failure occurs, then the solenoid or actuator activates so as to cause release mechanism 150 to allow gravity to move the lower stop sign section 144 to the deployed position thereof, such that the stop sign can be observed by oncoming motorists. Since there is no external electrical power available during a power outage, the electrical power needed to release and deploy a power outage, the electrical power needed to release and deploy the stop sign is provided to solenoid or actuator 151 by the rechargeable battery. Since this is a 12-volt DC battery, the release mechanism is preferably a conventional automotive trunk release mechanism.

Optionally, a spring preferably located in hinge 145 may be utilized to assist movement of the lower stop sign section from the stowed position (FIGS. 11 and 13) to the deployed position (FIG. 12) thereof. A spring may similarly be utilized to cause the lower stop sign section to move from the stowed position to the deployed position thereof when the stop sign is positioned or configured such that gravity will not effect such movement. Thus, a stop sign or any other desired sign may be mounted in various different positions and still be caused to move from a stowed to a deployed position upon activation of a release mechanism, such as may be effected by a loss of power.

A toroidal current transformer 175 or the like may be installed such that the hot or power wires for each of the red, yellow and green traffic signal lights pass therethrough or such that a common or return line passes therethrough, so as to provide an indication of the presence of current to the traffic signal. Deployment of the deployable traffic sign 140 is preferably delayed by at least 2 to 10 seconds after current loss is sensed, so that it does not deploy in the event of a short duration power fluctuation.

As shown in FIG. 11, the solar panel 20 is preferably mounted atop the pole 141. Alternatively, the solar panel 20 may be mounted at any other convenient location, such as at some point upon the pole intermediate the deployable stop sign 140 and the top of the pole or upon the deployable stop sign 140 itself.

When the solenoid or actuator 151 deactivates so as to effect deployment of the deployable stop sign 140, the LED blinking cycle for the LEDs 45*a*–45*h* also starts. Preferably, the LEDs 45*a*–45*h* continue to blink until the restoration of electrical power has been detected.

Optionally, the LEDs 45*a*–45*h* may be controlled so as to blink only at night or in near darkness or adverse weather conditions, or may be pre-programmed to blink according to a predetermined schedule according to either a real time or dusk/dawn timer.

After power has been restored, then a maintenance technician can restore the deployable stop sign 142 its stowed position. Preferably, a latch holds the lower sign section 144 in the deployed position thereof. Thus, the maintenance technician may be required to unlatch the lower sign section 144 so as to effect its return to the stowed position thereof.

The outside surface of the stowed deployable stop sign 140 may optionally be used as a sign, a community identification emblem or as any other desired type of conventional sign.

According to another preferred embodiment of the present invention, a lightweight, portable LED illuminated traffic sign system with a sign-mounted rechargeable battery preferably allowing at least fifty hours of LED operation at a 50 percent duty cycle is further described herein. Such a portable traffic sign is widely acceptable for a variety of different applications including emergency or police uses, for example, at traffic accident sites, checkpoints, construction projects, traffic signal outages, etc.

Such a portable preferred embodiment of the present invention preferably comprises an 18-inch stop sign constructed from 16-gauge sheet metal and weighing approximately two pounds. Eight LEDs having water-resistant housing similar to those shown in FIG. 6 are preferably powered by a single 1600 milliamp-hour rechargeable nickel metal hydride (NiMH) battery and a main control circuit which add only approximately two pounds to the weight of the stop sign. A wire frame mounting stand, preferably using ¼-inch diameter wire including attachment points to the 18-inch stop sign add approximately another four pounds. The total weight of such an 18-inch portable LED illuminated stop sign is approximately only eight pounds.

Such a completely portable LED illuminated stop sign with a 1600 milliamp-hour battery is thus designed to operate for at least fifty hours at 50 percent duty cycle with eight LEDs, each blinking with at least 6,000 millicandella of output light. The 1600 milliamp-hour NiMH battery may be recharged using a polarized 2-wire plug from any vehicle 12-volt DC electrical system or from a 120-volt AC power source using an appropriate charger.

For example, the present invention may be configured so as to indicate the presence of a dangerous curve using a number of LED defined arrows or chevrons which may be controlled so as to operate in a desired sequence which clearly indicates the direction of an upcoming turn in the roadway ahead.

According to one preferred embodiment of the present invention, remote control activation of the LEDs by emergency vehicles such as police cars, ambulances, fire trucks, military vehicles or an intelligent traffic system (ITS) is facilitated. Thus, the so-called "firehouse pre-empt" is an override transponder operated by radio or ITS control which is presently used in some cities to remotely control traffic signal lights so as to facilitate safer and faster response by firefighting vehicles. Other types of remote control transponders could be used to either selectively start, or double or triple the LED blinking rate on individual LED-activated traffic signs to thereby allow police or other emergency vehicles to provide enhanced awareness of emergency conditions by remote control. Still another type of remote control from police vehicle transponder or ITS control could effectuate deployment and onset of LED blinking cycles in traffic signs which are normally mounted in a stowed and non-blinking condition.

The present invention may further comprise hand-held stop paddles for use by crossing guards, which are actuated using a manual switch mounted in the stop paddle and which can be recharged using a suitable charging device.

The enhanced visibility traffic signal of the present invention may be constructed by either retrofitting an existing traffic signal such as a stop sign or by custom manufacturing new traffic signals.

According to an alternative preferred embodiment of the present invention, one or more photodetectors or radar detectors is aimed toward oncoming motor vehicle traffic, so as to detect the approach of a motor vehicle at night or in overcast weather conditions. The blink cycle time may be increased to provide additional visibility during the approach of a motor vehicle and then reset to a normal, e.g., lower, rate after the motor vehicle has passed by.

It is understood that the exemplary traffic control signs described herein and shown in the drawings represent only presently preferred embodiments of the invention. Various modifications and additions may be made to such embodiments without departing from the spirit and scope of the invention.

What is claimed is:

1. A traffic control signal comprising:

a structure having traffic control indicia formed thereon;

two or more LEDs mounted on the structure, each LED having an output light intensity of at least 6,000 millicandella, wherein each such LED is disconnectable without interrupting the operation of any other such LED, and wherein each such LED is individually mounted on approximately the same plane and separate from one another to provide discrete points of light as viewed by oncoming traffic when approaching said structure;

a power source for providing direct current to the two or more LEDs mounted on the structure; and a control circuit for regulating a duty cycle of the two or more LEDs to operate at some desired blink frequency.

2. The traffic control signal as recited in claim 1, wherein each LED has an output intensity of greater than 6,000 millicandella.

3. The traffic control signal as recited in claim 1, wherein the power source comprises an external supply of suitable electrical power or a battery which can be recharged from an external supply of suitable electric power.

4. The traffic control signal as recited in claim 1, wherein the power source comprises a suitable solar photovoltaic panel suitably configured to charge a suitable rechargeable battery.

5. The traffic control signal as recited in claim 4, wherein the solar photovoltaic panel provides an output voltage roughly in proportion to ambient light intensity, which varies in accordance with day or night conditions.

6. The traffic control signal as recited in claim 5, wherein the control circuit regulates the output light intensity of the two or more LEDs roughly in proportion to the ambient light intensity.

7. The traffic control signal as recited in claim 4, wherein the rechargeable battery is a nickel metal hydride battery.

8. The traffic control signal as recited in claim 1, wherein the structure defines a stop sign.

9. The traffic control signal as recited in claim 1, wherein the structure is selected from conventional traffic signs selected from a group consisting of:

red regulatory signs, including stop, do not enter, wrong way, yield, no U turn, and no left turn signs;

white regulatory signs, including speed limit, one-way, direction arrows, no turns, do not pass, pass with care, no turns, stop here on red, car pools only, trucks use right lane, and keep right signs;

yellow warning signs, including curve warning, stop ahead, yield ahead, road narrows, bump, loose gravel, pavement ends, truck crossing, lane ends, merge, loose gravel, and caution signs;

orange construction signs, including road work ahead, soft shoulder, detour ahead, slow, low shoulder, one lane road, construction ahead, and detour signs, and;

blue information signs, including call box, rest area, and police signs.

10. The traffic control signal as recited in claim 9, wherein the two or more LEDs have similar color as the color of the traffic sign.

11. The traffic control signal as recited in claim 9, wherein the two or more LEDs used with the white speed limit sign are amber or yellow in color.

12. The traffic control signal as recited in claim 1, wherein the structure defines a traffic sign.

13. The traffic control signal as recited in claim 1, wherein the structure comprises a hand-held paddle suitable for use by road work crews, school crossing guards, emergency crews including firemen and police officers, and other types of workers on public or private roadways.

14. The traffic control signal as recited in claim 1, wherein the control circuit is coupled to the two or more LEDs so as to define duty cycles that can optionally be changed.

15. The traffic control signal as recited in claim 1, further comprising a control circuit coupled to the two or more LEDs so as to define a variable duty cycle.

16. The traffic control signal as recited in claim 1, wherein the two or more LEDs include an optical collimating lens for focusing the output light into a cone having an illumination angle approximately 20 degrees or less.

17. The traffic control signal as recited in claim 1, wherein the two or more LEDs are each enclosed in a waterproof housing and wherein the waterproof housing is mounted on the structure.

18. The traffic control signal as recited in claim 1, wherein the two or more LEDs have a same general color as a background color of the structure on which the two or more LEDs are mounted.

19. The traffic control signal as recited in claim 1, wherein the two or more LEDs are mounted at a periphery of the structure to define a visual target area formed by the two or more LEDs when the two or more LEDs blink, wherein the mounting arrangement of the two or more LEDs approximately defines maximum dimensions of the structure.

20. The traffic control signal as recited in claim 1, further comprising an external power port for coupling an external power source to effect illumination of the two or more LEDs.

21. A method for enhancing visibility of conventional traffic signs or structures by mounting two or more discrete LEDs thereupon, directing the two or more LEDs such that an output light from each LED is aimed approximately towards oncoming traffic, positioning the two or more LEDs so as to form a recognizable geometric pattern and approximately defining a physical size of the sign or structure, wherein each of said one or more LEDs:

provides an output light intensity of 6,000 millicandella or more;

is disconnectable without interrupting the operation of any other such LED;

is provided with a suitable source of direct current electrical power; and is caused to blink at a desired frequency by a suitable blink cycle timer and control circuit.

22. The traffic control signal as recited in claim 21, wherein the two or more LEDs are mounted at the periphery of the sign or structure to define a visual target area formed by the two or more LEDs as the two or more LEDs blink.

23. The traffic control signal as recited in claim 21, wherein the two or more LEDs have a same general color as a primary background color of the sign or structure on which the two or more LEDs are mounted.

24. A method for enhancing visual perception of a traffic sign comprising a structure, the method comprising:

mounting two or more LEDs on the structure such that an output light from each LED is aimed approximately towards oncoming motor vehicle traffic, wherein the two or more LEDs are located at vertices or midpoints between vertices along at least a portion of a periphery of the structure to visually define a physical size of the structure with blinking of the two or more LEDs;

connecting the two or more LEDs with an electrical power source and with a blink cycle timer such that the electrical power energizes the blink cycle timer which then causes the two or more LEDs to blink, wherein the electrical power is derived either from an external source of electric power or from sunlight by suitable solar photovoltaic panel and rechargeable battery means; and wherein each of the two or more LEDs:

provides an output light intensity of at least 6,000 millicandella, and is electrically disconnectable from the electrical power without interrupting the blinking operation of any remaining LEDs.

25. A method for enhancing the visibility of a traffic sign, the method comprising:

mounting two or more LEDs on a traffic control structure, each of the one or more LEDs being configured such that:

output light of each LED forms a cone angle less than approximately 20 degrees;

output light intensity of each LED is at least 6,000 millicandella; and each LED is aimed approximately towards oncoming motor vehicle traffic.

26. A method for enhancing visibility of conventional traffic signs or structures by mounting two or more LEDs thereupon such that output light from each LED is aimed approximately towards oncoming motor vehicle traffic, wherein each LED:

is disconnectable from the traffic sign or structure without interrupting the blinking operation of any remaining LEDs;

provides an output light intensity of 6,000 millicandella or more; and is provided with suitable direct current electrical power derived from a suitable source, wherein a suitable control circuit and blink cycle timer means is used to effect illumination of the two or more LEDs.

27. The method of claim 26, further comprising a duty cycle control circuit coupled to the two or more LEDs so as to define a variable duty cycle for the two or more LEDs.

28. The method of claim 26, further comprising an external power port for coupling an external power source is used to effect illumination two or more LEDs.

29. The method of claim 26, further comprising an override control circuit for facilitating external control of the LEDs.

30. The method of claim 26, further comprising a multiple sign control circuit configured to facilitate control of LEDs on a plurality of traffic control signs.

31. The method of claim 26, further comprising a multiple intersection control circuit configured to control traffic control signals at a plurality of intersections.

32. The method of claim 26, further comprising a sensor for sensing the approach of a motor vehicle and a control circuit configured to activate the two or more LEDs or control the blink rate of the two or more LEDs based on the approach of the motor vehicle.

* * * * *

UNITED STATES PATENT AND TRADEMARK OFFICE

CERTIFICATE OF CORRECTION

PATENT NO. : 6,943,698 B2
DATED : September 13, 2005
INVENTOR(S) : Jones et al.

It is certified that error appears in the above-identified patent and that said Letters Patent is hereby corrected as shown below:

Title page,
Item [75], Inventors, Jerry A. Williams and Priscilla Williams, delete "2331 S. Hall St. Visalia, CA (US) 93277" and insert -- 1270 Humboldt Drive, Nipomo, CA (US) 93444 --.

Column 16,
Line 32, delete "no turns" (First occurrence).

Column 18,
Line 39, delete "is".
Line 40, insert -- of -- between "illumination" and "two".

Signed and Sealed this

Eleventh Day of April, 2006

JON W. DUDAS
*Director of the United States Patent and Trademark Office*